United States Patent [19]

Little

[11] Patent Number: 4,807,874

[45] Date of Patent: Feb. 28, 1989

[54] COMBINATION PLANTAR FLEXION/DORSIFLEXION ANKLE MACHINE

[76] Inventor: Lloyd R. Little, 265 W. 8th St., Island Plz., Ship Bottom, N.J. 08008

[21] Appl. No.: 77,610

[22] Filed: Jul. 24, 1987

[51] Int. Cl.[4] ..... A63B 23/04; A63B 21/06

[52] U.S. Cl. ..... 272/96; 272/118

[58] Field of Search ..... 272/96, 117, 118, 130, 272/134, DIG. 4

[56] References Cited

U.S. PATENT DOCUMENTS

| | | | |
|---|---|---|---|
| 2,542,074 | 2/1951 | Bierman | 272/96 |
| 3,998,454 | 12/1976 | Jones | 272/117 |
| 4,149,713 | 4/1979 | McLedd | 272/117 |
| 4,311,305 | 1/1982 | Lambert, Jr. et al. | 272/118 |
| 4,349,192 | 9/1982 | Lambert, Jr. et al. | 272/118 |
| 4,349,194 | 9/1982 | Lambert, Jr. et al. | 272/118 |
| 4,452,447 | 6/1984 | Lepley et al. | 272/130 |
| 4,511,137 | 4/1985 | Jones | 272/118 |
| 4,600,188 | 7/1986 | Bangerter et al. | 272/118 X |
| 4,605,220 | 8/1986 | Troxel | 272/130 X |
| 4,650,183 | 3/1987 | McIntyre | 272/130 X |

*Primary Examiner*—V. Millin
*Assistant Examiner*—Robert D. Bahr
*Attorney, Agent, or Firm*—Richard C. Litman

[57] ABSTRACT

This device relates to an ankle rehabilitation and ankle fitness devices. The device is equipped with apparatus to adjust ankle position and varying amount of resistance which enables the user to progressively strengthen the ankle. The device also functions in a manner to enable the user to isolate and exercise the plantar and dorsal muscle groups of the lower leg and ankle joint, separately.

1 Claim, 3 Drawing Sheets

COMBINATION PLANTAR FLEXION/DORSIFLEXION ANKLE MACHINE

BACKGROUND OF INVENTION

1. Field of Invention

The invention relates to a combination ankle motion, exerciser and development machine, and more particularly, the invention is directed to an improved ankle rehabilitation and ankle fitness machine. The combination ankle machine described herein is designed to rehabilitate and strengthen the plantar and dorsal muscle groups of the foot and ankle.

The invention further relates to an improved method of ankle rehabilitation and fitness which provides a method to strengthen vital lower extremity muscular development previously neglected by fitness programs. The machine is designed to progressively condition and strengthen the ankle joint and various muscle groups of the lower leg. Progressive development in these areas will enhance athletic performance and provide insurance against injury in all activities involving running and jumping. In addition, the use of these machines will provide benefit to the fitness conscious person and improve the well-being member of the general public who use the apparatus.

The combination plantar flexion/dorsiflexion ankle machine of the invention may be used in a variety of fields, but is directed particularly toward rehabilitation and fitness. First, rehabilitation centers could use this equipment therapeutically to help bring about a recovery of various types of ankle and lower leg injuries. Proper rehabilitation prevents recurring and repetitive injuries, which are often due to resuming activities without proper treatment. Second, fitness centers could use this equipment within various exercise programs to strengthen plantar flexion and dorsiflexion movement of the ankle and foot.

2. Description of the Prior Art

Various prior art ankle machines and ankle exercisers and the like, as well as the apparatus and method of their construction in general, are known, and those found to be exemplary of the U.S. prior art are U.S. Pat. Nos. 2,830,816, 3,525,522, 4,159,111, 4,199,137 and 4,371,160.

U.S. Pat. No. 4,199,137 to Giguere discloses an apparatus which provides for progressive foot rehabilitation. This machine is directed toward a rehabilitation device for recovering patients of fractures of the ankle bone as well as in certain cases of ankle sprain or strain. The Giguere patent discloses a machine which provides for ankle rehabilitation while standing or sitting. While the Giguere patent discloses similar functions including plantar flexion and dorsiflextion, it does not comprise all the features of my invention. First, this invention utilizes spring operated tension for resistance. In contrast, my invention utilizes weights for resistance. This provides for a more accurate method of measuring progress and eliminates the problem of variable elasticity coefficients commonly occuring in spring operated systems. Furthermore, my invention provides for a pin operated resistance selector, whereas the Giguere invention uses a wingnut operated resistance selector. Second, the Giguere invention has a ball-and-socket fulcrum of rotation located near the center of the foot. My invention utilizes brass bushings for the fulcrum of rotation and is positioned at the ankle joint where both horizontal and vertical rotations of the foot take place. The position of the fulcrum of rotation of my invention further provides isolation of muscle groups of the ankle not provided for in the Giguere invention.

Other various prior art ankle machines and ankle exercisers and the like disclosed in the above-mentioned patents, are designed for rehabilitation or strengthening of dorsal muscle groups. These inventions were designed to exercise only one motion of the foot, whereas my invention provides for both plantar flexion and dorsiflexion motions. Furthermore, these various prior art devices provide resistance by spring tension, elastic tension, and or direct friction, whereas my invention provides standard 10 lb steel plates for resistance on plantar flexion exercise and standard 5 pound steel plates for the dorsiflexion exercise.

These patents or known prior uses teach and disclose various types of ankle rehabilitation and ankle exercise devices of sorts and of various manufactures and the like, as well as methods of their construction; but none of them, whether taken singly or in combination, disclose the specific details of the combination of the invention in such a way as to bear upon the claims of the present invention.

SUMMARY OF THE INVENTION

An object, advantage, and feature of the invention is to provide a novel and improved construction of an ankle rehabilitation and fitness machine.

Another object of the invention is directed further to a device safe and efficient in use, and lends itself to the physical therapy and physical fitness industries. This invention is directed further to a device providing for easy rehabilitation from all sorts of lower leg and ankle injuries and the strengthening of lower leg and ankle muscle groups. Mainly, plantar flexion and dorsiflexion motions, that is, rotation of feet downward and away from lower legs and rotation of feet upward and toward lower legs, respectively, are enhanced by this device.

Another object of the invention is to provide a novel and improved construction of an ankle rehabilitation and fitness machine, which is designed to include the concepts of isotonic exercise, isometric exercise, joint isolation, common axis rotation of ankle joint and cam, full range of motion, and variable resistance.

These, together with other objects and advantages of the invention reside in the details of the process and the operation thereof, as is more fully hereinafter described and claimed. Reference are made to drawings forming a part hereof, wherein like numerals refer to like parts throughout.

DESCRIPTION OF THE PREFERRED EMBODIMENT OF THE INVENTION

Figures 1, 1A:
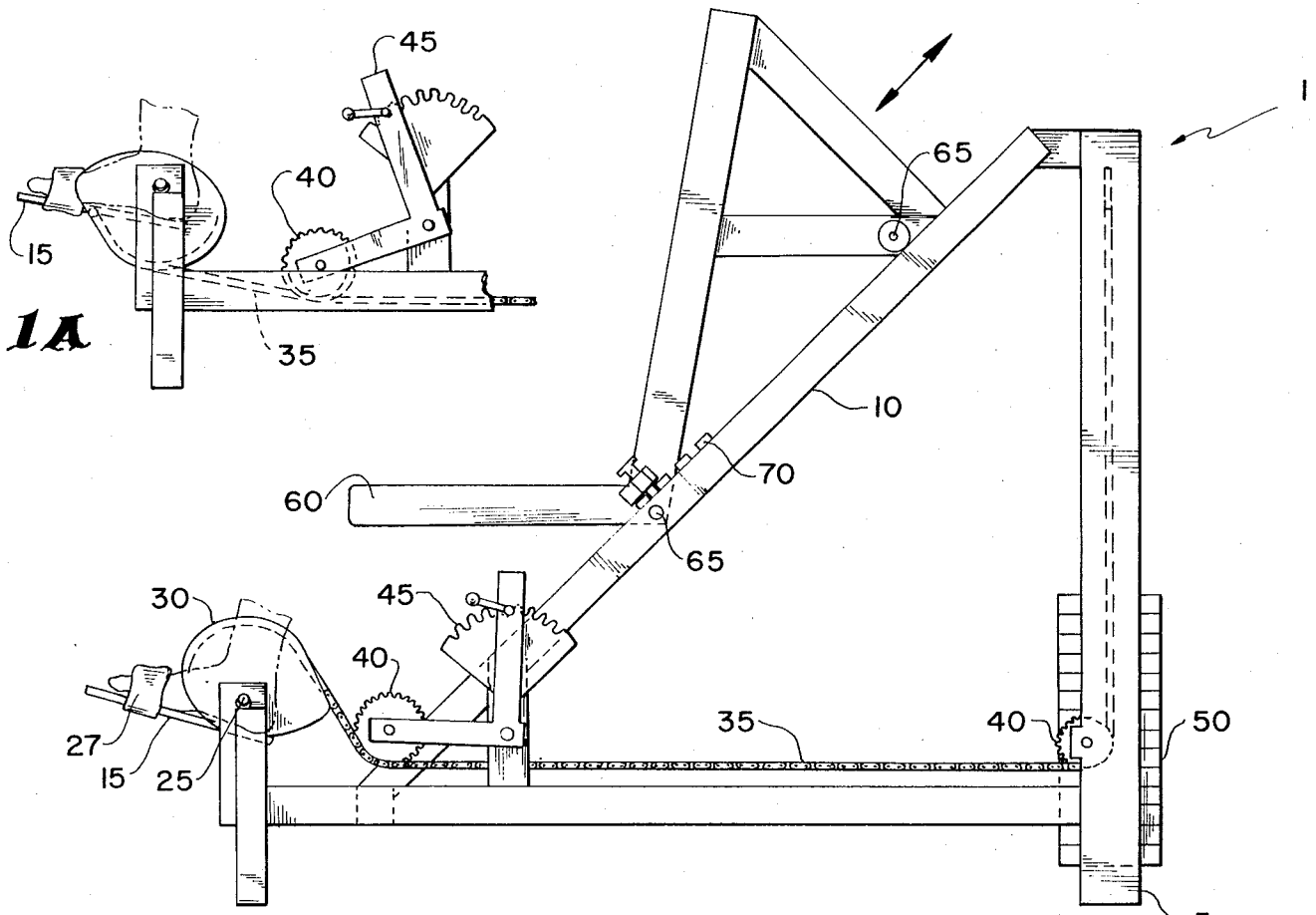
FIG. 1 is a side view of the combination plantar flexion/dorsiflexion ankle machine according to a preferred embodiment and best mode of the present invention.
FIG. 1A is a detail view illustrating the sprocket mechanism.

Referring now to the drawings there is shown in FIG. 1, a side view of the combination plantar flexion/-dorsiflexion ankle machine 1 comprising the base 5, frame 10, plantar flexion foot pedal 15, horizontal pivoting means brass bushing 25, foot strap 27 to tie the foot of a person to the pedal 15, semi-circular cam 30, chain or elongate connection means 35, sprockets 40, adjustment lever 45, a pin operated ten pound weight stack 50 resistance means, double seat 60, seat wheels 65, and seat adjustment track 70.

The side adjustment lever 45 provides a means for adjusting the chain 35 to allow for changes in the range of motion of the foot pedals 15 and 20, as indicated in FIG. 1A. The seat 60 is adjustable in one inch increments by sliding the seat wheels 65 along adjustment track 70.

Figure 2:
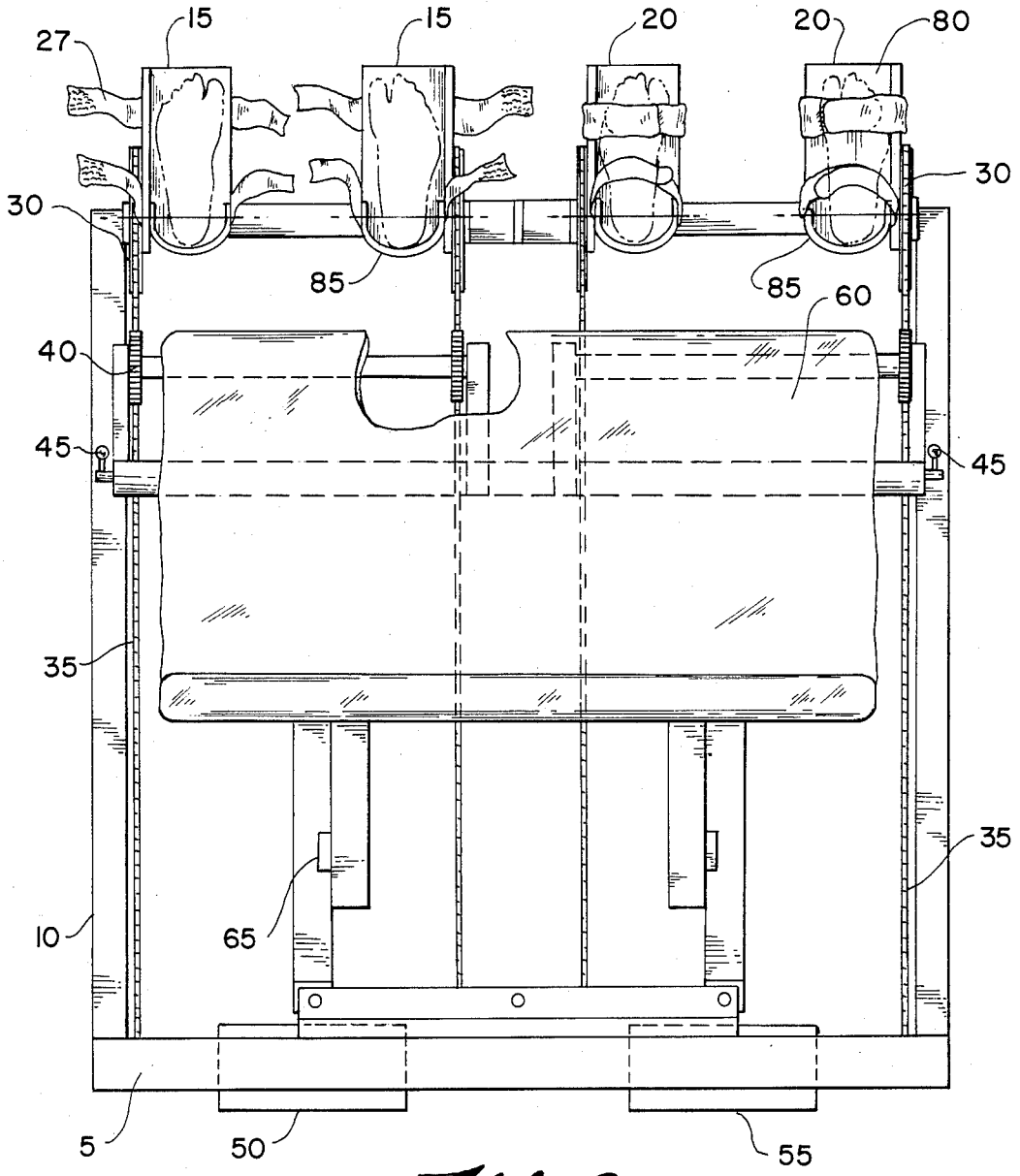
FIG. 2 is a top view of the combination plantar flexion/dorsiflexion ankle machine according to a preferred embodiment and best mode of the present invention.

FIG. 2, a top view of the invention, illustrates the members shown in FIG. 1 including hidden surfaces. It further illustrates both plantar flexion foot pedals 15 and dorsiflexion foot pedals 20, two sets of semi-circular cams 30, two chains 35, two adjustment levers 45, a pin-operated five-pound weight stack 55, padded foot attachments to dorsiflexion foot pedals 80, and heel adjusters 85 for foot pedals 15 and 20. The stable base 5 rests on the floor. The frame 10 secured to the base 5, embodies and supports all members. When pressure is applied to the plantar flexion pedals 15 or the dorsiflexion pedals 20, the semi-circular cam 30 is set in motion around the brass bushing 25. This, in turn, increases tension or resistance variably with angular displacement of the pedal on the chain 35 which is attached to the cam 30 meeting the cam rim at the varying radius of the cam 30. The force of the chain 35 tension is directed by sprockets 40 to the adjustable weight stacks 50 or 55 and in turn raises the weights. In a similar fashion, the weights are lowered by releasing the pressure to the pedals 15 or 20.

Figure 3:
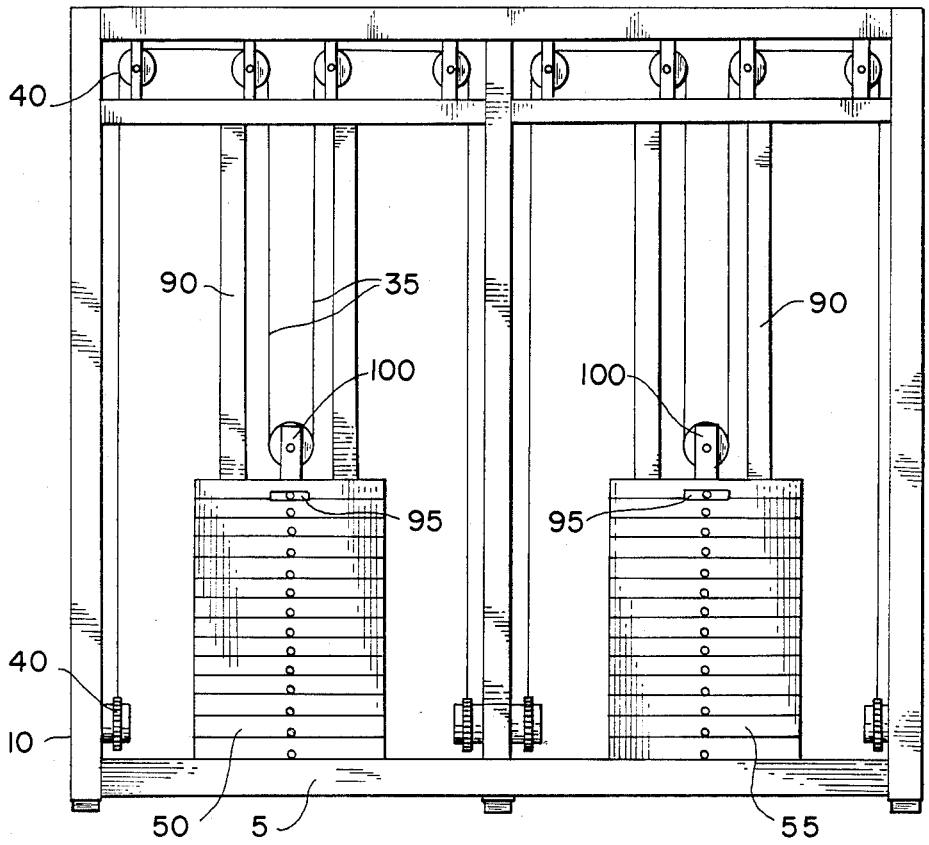
FIG. 3 is a rear view of the combination plantar flexion/dorsiflexion ankle machine according to a preferred embodiment and best mode of the present invention.

FIG. 3, a rear view of the invention, illustrates the base 5, frame 10, two chains 35, sprockets 40, a pin operated ten pound weight stack 50, a pin operated five pound weight stack 55, two sets of guide rods 90, two weight selector pins 95, redirectionals 100.

The user inserts the weight selector pin 95 at the desired level of resistance of the weight stack 50 for plantar flexion exercises and of the weight stack 55 for dorsiflexion exercises. The user adjusts the double seat 60 to its proper height along seat adjustment track 70, proper height adjustment is obtained when the users knees are located slightly behind the ankles. Heel adjusters 85 of foot pedals 15 and 20 are adjusted forward or backward so the axis of the ankle joints are aligned with the axis of the semi-circular cams 30.

For the plantar flexion exercise, the user straps feet into plantar flexion foot pedals 15 and sets left adjustment lever 45 to the desired range of motion. To begin exercise, the user sits in seat 60 and applies pressure to foot pedals 15 by pressing feet down and away from the lower leg.

For the dorsiflexion exercise, the user places feet into foot pads 80, straps feet into dorsiflexion foot pedals 20 and sets right adjustment lever 45 into the desired range of motion. To begin exercise, the user sits in seat 60 and applies pressure to foot pedals 20 by pulling feet up and toward the lower leg.

The plantar flexion and dorsiflexion exercises can be performed one foot at a time or both feet together. In either exercises and with one foot or both feet, full rotation occurs after a pushing or pulling pressure has been applied and released. The rotation of the foot pedals 15 and 20 revolve around the horizontal brass bushings 25 in vicinity of the heel position of the foot. The semi-circular cams 30 rotate in unison with the foot pedals 15 when the feet are plantar flexed or in unison with the foot pedals 20 when the feet are dorsiflexed. Either action, plantar flexion or dorsiflexion, causes the chain 35 to pull the selected resistance of weight stack 50 for plantar flexion or weight stack 55 for dorsiflexion which, in turn, provides the work load.

Resistance for either exercise is varied by the use of variable resistant cams.

In general, this device isolates the ankle joint to act as the focal point of rotation for two exercise motions of the feet. The user performs the exercise motions by selecting a resistance, adjusting chair height, adjusting range of motion, attaching feet to foot pedals, and applying either plantar flexion pressure or dorsiflexion pressure, respectively. Separate foot pedals are provided for each exercise motion. Horizontal brass bushings 25 allow for said ankle rotations. Heel adjusters 85 allow the user to align the axis of the ankle joint with the axis of the semi-circular cams. The semi-circular cams 30 and the foot pedals 15 or 20 rotate in unison during the exercise. Side adjustment levers 45 provide the full range of motion for each exercise. Chains 35 transfer the resistance from the weight stacks 50 and 55 to the semicircular cams 30, to the foot pedals 15 or 20, and ultimately to the muscles of the lower legs.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, fall within the scope of the invention.

What is claimed is:

1. An exercise apparatus comprising:

pedal means for restraining a foot, from heel to toe, of a person to exercise in plantar flexion and dorsi flexion, said pedal means defining a plane;

pivot means defining a pivot axis for said pedal means, said pivot axis being above the plane of said pedal means:

resistance means for resisting angular displacement of said pedal means;

elongate, flexible connection means for transmitting force between said pedal means and said resistance means;

guide means defining a path of travel for said connection means, said connection means being trained about said guide means;

cam means mounted on said pedal means coaxially with said pivot means, said connection means being trained about said cam means for providing a variable resistance in response to angular displacement of said pedal means; and, means for adjusting the angular range of motion of the pedal means.

* * * * *